US005318636A

United States Patent [19]

Szücs

[11] Patent Number: 5,318,636

[45] Date of Patent: Jun. 7, 1994

[54] METHOD FOR CLEANING SURFACES, IN PARTICULAR SENSITIVE SURFACES

[75] Inventor: Johann Szücs, München, Fed. Rep. of Germany

[73] Assignees: Eva Abony Szucs, Munich; Peter Brau, Coburg, both of Fed. Rep. of Germany

[21] Appl. No.: 870,144

[22] Filed: Apr. 17, 1992

[30] Foreign Application Priority Data

Apr. 19, 1991 [DE] Fed. Rep. of Germany ..... 4112890
Sep. 5, 1991 [EP] European Pat. Off. ..... 9114993.8

[51] Int. Cl.[5] ..... B08B 7/00; B24C 1/00
[52] U.S. Cl. ..... 134/7; 51/320
[58] Field of Search ..... 134/7; 51/320

[56] References Cited

U.S. PATENT DOCUMENTS

| | | | |
|---|---|---|---|
| 3,676,963 | 7/1972 | Rice et al. | 51/320 |
| 4,125,969 | 11/1978 | Easton | 51/320 |
| 5,147,466 | 9/1992 | Ohmori et al. | 134/7 |

FOREIGN PATENT DOCUMENTS

| | | |
|---|---|---|
| 0171488 | 2/1986 | European Pat. Off. . |
| 0192088 | 8/1986 | European Pat. Off. . |
| 0266859 | 5/1988 | European Pat. Off. . |
| 0316264A2 | 5/1989 | European Pat. Off. . |
| 0374291A1 | 6/1990 | European Pat. Off. . |
| 2524156A1 | 1/1976 | Fed. Rep. of Germany . |
| 2543019C2 | 4/1976 | Fed. Rep. of Germany . |
| 2003673 | 4/1983 | Fed. Rep. of Germany . |
| 3434163C2 | 4/1985 | Fed. Rep. of Germany . |
| 3505675A1 | 8/1986 | Fed. Rep. of Germany . |
| 3937221A1 | 5/1990 | Fed. Rep. of Germany . |
| 4030434A1 | 4/1991 | Fed. Rep. of Germany . |
| 0791688 | 12/1935 | France . |
| 2375901 | 7/1978 | France . |
| 2494160 | 5/1982 | France . |
| 2627121A1 | 8/1989 | France . |
| 2042399A | 9/1980 | United Kingdom . |
| 2145643A | 4/1985 | United Kingdom . |

OTHER PUBLICATIONS

German publication: W. H. R. Ott, "Zum Stand der Strahltechnik", in Blech-Rohre-Profile 27 (1980) 7, S. 437-442 no translation.

Patent Abstract of Japan, JP 63-29515 A, Feb. 8, 1988.

*Primary Examiner*—R. Bruce Breneman
*Assistant Examiner*—Zeinab El-Arini
*Attorney, Agent, or Firm*—Nikaido, Marmelstein, Murray & Oram

[57] ABSTRACT

The present invention relates to a method and an apparatus for cleaning surfaces, in particular sensitive surfaces contaminated and attacked by environmental influences, by means of a jet of fine grain blast material and air. A blast material is used which contains crystals and/or particles of at least one cleaning agent crystallized by cooling.

12 Claims, 4 Drawing Sheets

METHOD FOR CLEANING SURFACES, IN PARTICULAR SENSITIVE SURFACES

BACKGROUND OF THE INVENTION

1. Field of the Invention

The invention relates to a method and an apparatus for cleaning surfaces, in particular sensitive surfaces, which are contaminated by environmental influences. The method described here is a further development of the cleaning method for surfaces according to European patent no. 0 171 448.

2. Description of the Prior Art

In the aforementioned patent specification several substances are mentioned as suitable blast material, that is in particular sharp-edged blast material such as sand (a silicon compound), quartz, corundum, or flue ash. These blast materials are united in the form of a blast material/air jet in a mixing head with an air/water jet to form a total jet disposed in inherent rotation. The atomized total jet emerging from the mixing head is directed onto the surface to be cleaned, said total jet rotating about its centre axis and being similar to a cone diverging in the jet propagation direction.

Since, in particular with highly sensitive surfaces the aforementioned sharp-edged blast materials can lead to removal of surface layers and thus to damaging of the surfaces, it is proposed in European patent application no. 88 121 432.4 to employ blast materials of low hardness, i.e. a hardness which as a rule is less than the hardness of the materials to be cleaned, so that although the dirt or contaminating layers are satisfactorily removed the material surface to be cleaned cannot be destroyed. In the method described in this publication mineral blast materials are used which have a hardness (Mohs' hardness) of at the most 4, as is the case with dolomite, which is specified as preferred rock-forming mineral. However, in many cases this method makes a subsequent washing of the cleaned surfaces necessary and also presents the problem that the mineral blast material, for example dolomite dust, can get into waste water and cause considerable problems there.

SUMMARY OF THE INVENTION

The problem underlying the invention is to provide a method and an apparatus for cleaning surfaces, in particular sensitive surfaces, which avoid the aforementioned disadvantages of the prior art; in particular, a method and an apparatus are proposed which permit a thorough but careful and at the same time environmentally compatible cleaning of sensitive surfaces and can be implemented with the minimum possible apparatus expenditure.

The invention therefore proposes in a method for cleaning surfaces, in particular sensitive surfaces contaminated and attacked by environmental influences, by means of a jet of fine-grain glass material and air, the improvement of using a blast material which contains particles of at least one cleaning agent crystallized by cooling.

The invention also proposes in an apparatus for cleaning surfaces, in particular sensitive surfaces contaminated and attacked by environmental influences, comprising a mixing head for mixing air and a liquid cleaning agent and a nozzle region for spraying a cleaning jet of air and a granulate, the improvement comprising an arrangement for the crystallization of the liquid cleaning agent of which the crystals are used as granulate.

Expedient embodiments are defined by the features of the subsidiary claims.

The advantage of the invention is to be seen in that the use of mineral blast materials can be dispensed with by crystallizing a liquid cleaning agent, usually water, by cooling to small finely dispersed particles and using said agent as blast materials. Initial preliminary tests have shown very good cleaning results. At the same time, the amount of environmentally hazardous materials introduced in particular into the waste water can be reduced to a minimum. If, as is the case in most uses, water is used as cleaning agent the environmental disadvantages are minimized. Nor is any subsequent working operation required for washing the blast material particles off a cleaned surface because the crystals melt and the melted liquid flows away.

According to the invention, the removal of dirt or contaminating layers on surfaces to be cleaned is effected by a cleaning jet which contains essentially finely dispersed ice crystals. Fundamentally, however, any crystallizable cleaning agent suitable for the cleaning purpose may be used or a mixture of cleaning agent and water.

The necessary crystal particles are generated according to the invention by cooling water or another suitable liquid cleaning agent. If hereinafter for simplicity reference is made only to water or ice particles, this is nevertheless intended to cover other suitable liquid cleaning agents and the crystal particles thereof. The term mixture jet is retained even in the case of a simple water jet to indicate that the jet may be formed by a plurality of different blast materials.

According to the invention, the cooling and the then following crystallization of the water to ice crystals may take place both in front of the mixing head, in the mixing head, or in a particularly advantageous manner behind the mixing head, i.e. within the already atomized mixture jet emerging from the nozzle region of the mixing head.

If the ice crystals are generated before the atomization, i.e. ice crystals supplied to the mixing head itself or generated directly there, for instance by supplying a pressurized gas serving as refrigerant instead of compressed air to the mixing region of the mixing head, then as initial experiments have shown there is a danger that in the nozzle region of the mixing head ice will form and obstruct the passage of the mixture jet. An effective remedy for this is a local heating of said nozzle region.

However, to avoid the occurrence of such difficulties from the start, according to a particularly preferred embodiment of the invention it is proposed that the already atomized mixture jet be cooled. This is done according to the invention by direct introduction of gaseous cooling agent or refrigerant jets into the mixture jet. The intimate heat exchange between refrigerant and water droplets produced by the direct contact ensures immediate ice crystallization of the finely atomized water particles.

The refrigerant can for this purpose be introduced into the mixture jet containing the atomized liquid particles in gaseous or liquid form whereby for example carbon dioxide and Freons have proved suitable as gaseous refrigerant for this purpose, especially with water as cleaning agent. Particularly good results are obtained when a liquid refrigerant is passed into the mixture jet, especially if the liquid refrigerant is sprayed into the mixture jet. Liquid refrigerants are well suited, especially liquid nitrogen, which is widely used as an industrial refrigerant. Its technology is well matured, the handling is easy, the refrigerant itself is comparably cheap and readily available. Another advantage worth stating is that nitrogen does not cause any problems to dispose. In tests concerning the inventive method, the nitrogen which has been injected into the mixture jet in its liquid form has been totally vaporized upon the crystallization of the cleaning particles. The same good results are expected if other suitable liquid refrigerants are used, whereby there may be some drawbacks with regard to the environment.

To avoid as far as possible any obstruction of the propagation of the conical mixture jet, the jet is preferably subjected to the gaseous refrigerant from the outside, because in this case a breaking up of the jet by the refrigerant supply can be avoided. Thereby it has been proven as being absolutely expedient to make the refrigerant emerge from nozzles arranged annularly about the mixture jet, but a single nozzle has been proven as already being completely sufficient and is even a preferred embodiment.

According to a particularly expedient embodiment of the invention, a ring member adjoins the nozzle region of the mixing head which is, according to the invention, provided with at least one refrigerant nozzle. The preferably rotating cleaning jet leaving the nozzle region is passed through the ring member, and the passage of the ring member is conically widened in the direction of the jet, but can, according to the invention, also be formed as a passage with a constant diameter. In adaptation to the nozzle region of the mixing head, this diameter may amount to 5 to 20 mm.

The refrigerant nozzles are provided with a refrigerant passage which may also be formed conically as well as—and this is a preferred embodiment of the invention—a simple through-bore. The middle axis of this refrigerant passage is inclined at an angle of about 30° to 60°, preferably at about 45°, to the middle axis of the cleaning jet in the jet direction. If the passage of the refrigerant nozzle(s) is/are formed as a simple through-bore, the diameter of such a through-bore is preferably 2 to 5 mm. The outlet of the passage of the nozzle is at a distance of between 10 and 30 mm, expediently between 20 and 25 mm, from the nozzle outlet of the mixing head with regard to the middle axis of this nozzle passage.

Very good results concerning the crystallization effect and the effect of the cleaning agent jet can be achieved if the middle axis of such a refrigerant passage intersects with the opposing wall of the ring member. This geometry is especially advantaguous if there is only one single refrigerant nozzle or if refrigerant nozzles are provided unevenly along the periphery of the ring member. The effect is in all cases, however, that the introduced refrigerant is reflected at the wall of the mixing head and that the attainable cooling effect is enhanced as compared to a refrigerant jet emerging the ring member freely. But in any case in principle satisfactory results are also obtainable. By this means the direction of the cleaning jet experiences the most minor change. If a rotating cleaning jet is used, which represents a preferred combination with the method of the invention, the rotation energy of the cleaning jet can be enhanced as a consequence of such an inclined cleaning agent nozzle or of refrigant nozzles arranged unsymetrically, by means of which the reflected refrigerant jets make a further addition. If the refrigerant nozzle is eccentrically arranged with regard to the middle axis of the cleaning jet, a further enhancement of the rotation energy can be achieved. The eccentricity should not exceed 1.5 mm.

If the assembly for the crystallization of the liquid cleaning agent is very compact, i.e. the ring member adjoins directly the mixing head, temperature problems may arise in the region between the mixing head and the "cold" ring member, especially if liquid refrigerant, for example liquid nitrogen, is used at their low temperatures. Negatively effected is less the lining of the nozzle region of the mixing head, which advantageously consists of a ceramic material, but most probably the shell of the mixing head, which in most cases consists of a plastics material. To avoid this problem, at least said shell is advantageously separated from the ring member by means of a heat insulation, which can be formed by an isolation ring.

According to another, expedient embodiment of the invention, a ring member is provided which is attached at a distance of 3 to 7 cm, preferably of approximately 5 cm, to the nozzle opening of the mixing head.

Thereby a geometry of mixture jet and refrigerant jet is achieved which results in an intensive mixing of the jets to create a sufficient quantity of ice particles and at the same time the disturbance of the rotation of the particles can be minimised.

The invention is not restricted to a cleaning method with a rotating cleaning jet although this method represents a preferred embodiment of the invention. The invention is also usable in connection with generic cleaning methods, for example those where the cleaning jet passes a linear trajectory before it impinges the surface which has to be cleaned.

The method described above is however not restricted to the sole use of ice crystals or crystal particles of another suitable cleaning agent; in a further expedient embodiment of the invention said method also permits the use of a mixture of crystal particles and mineral blast materials, for example dolomite dust or ground walnut kernels. By the admixing, the grain size distribution of the blast material can be specifically influenced, for example by the admixture containing precisely such grain sizes which in the course of the cooling and crystallization of water or another cleaning agent cannot be formed. It is an effect known from the prior art that the use of grains of different size leads to a better cleaning action than that of grains of identical size.

BRIEF DESCRIPTION OF THE DRAWINGS

The invention will now be explained in detail hereinafter with reference to a preferred embodiment with the aid of the drawings. Further advantages and features of the present invention will be apparent. In the drawings.

DESCRIPTION OF THE PREFERRED EMBODIMENT

Figure 1:
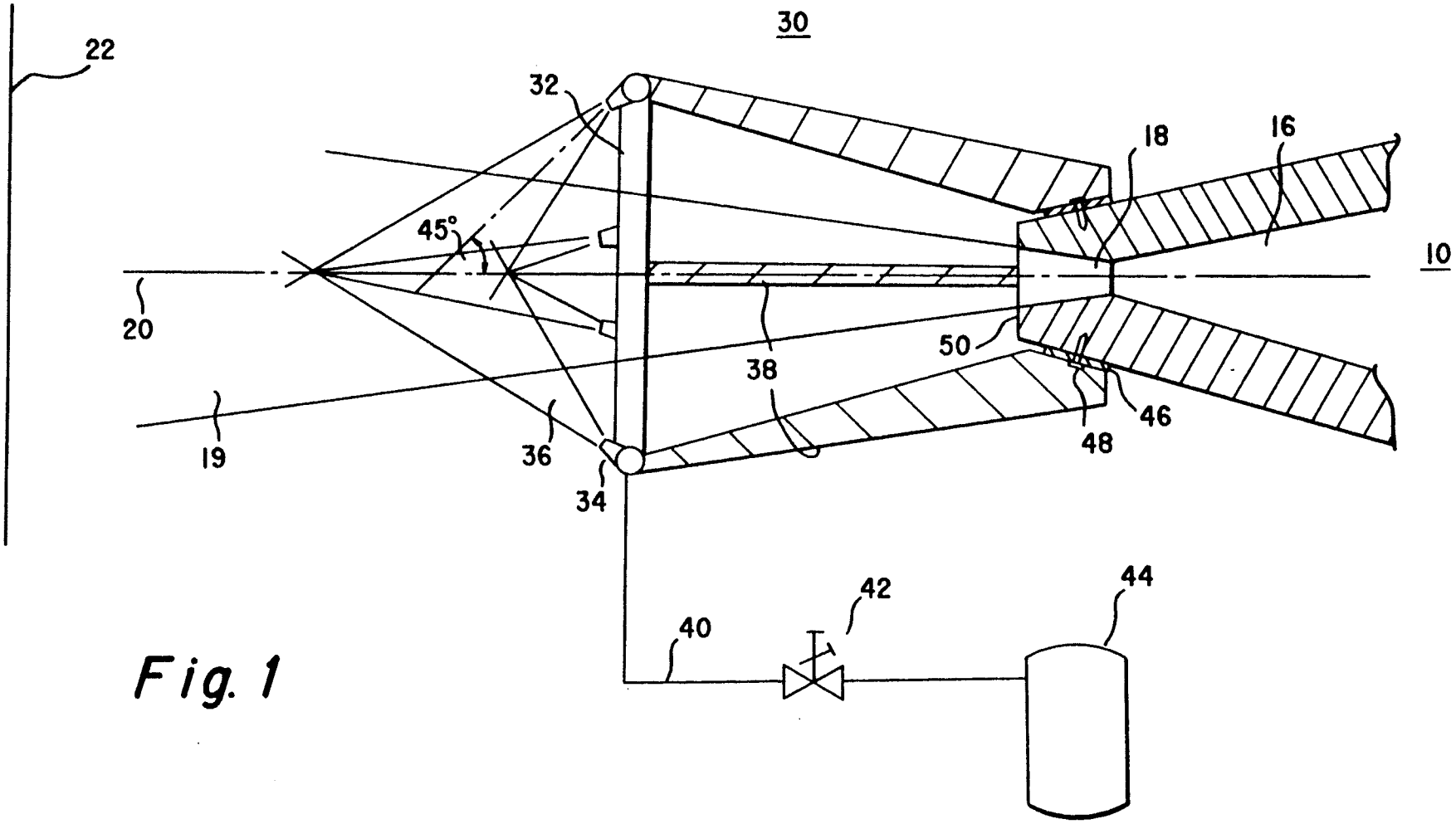
FIG. 1 shows in section an apparatus for carrying out the method according to the invention.

The apparatus shown in FIG. 1, which is designated generally as mixing head 10 and is suitable for carrying out the method according to the invention, comprises at the feed side two tube pieces with centre axes 12 and 14 through which the jet components can be introduced into the mixing head 10. A pressurized mixture of atomized water and air is supplied along the axis 12 to a mixing region 16 of the mixing head 10 and pressurized air is supplied along the axis 14. The pressure relationships in the two tube pieces and in the mixing region 16 are adapted to the particular use. Both tube pieces may be supplied with compressed air either from their own source or from a common compressed air source.

In the mixing region 16 the two subjets mix to form a total jet which as described in EP patent 0 171 448 is set into a rotational movement by the nature of the jet unification and the geometry of the mixing region 16. This total jet is then propagated on leaving a nozzle region 18 of the mixing head 10 in conical form along a conical centre axis 20 and impinges on the surface 22 of an object to be cleaned.

Figure 2:
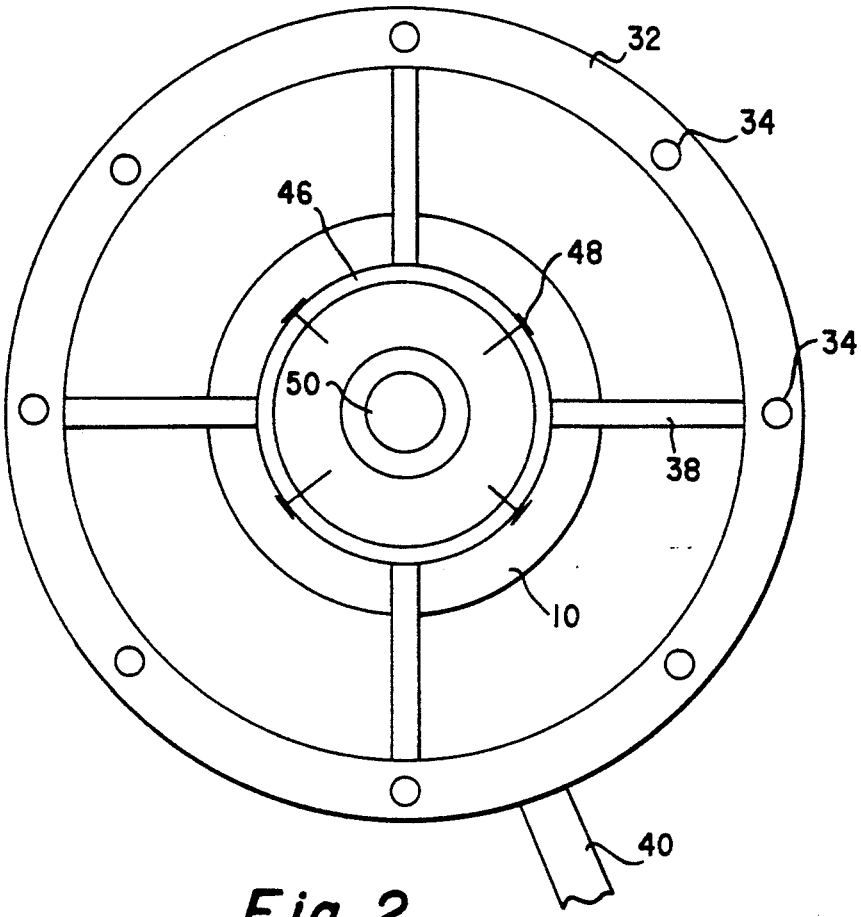
FIG. 2 is a sectional view of an apparatus according to the invention for introducing gaseous refrigerant into the mixture jet and FIG. 3 is a front view of the apparatus according to FIG. 2.
Figure 3:
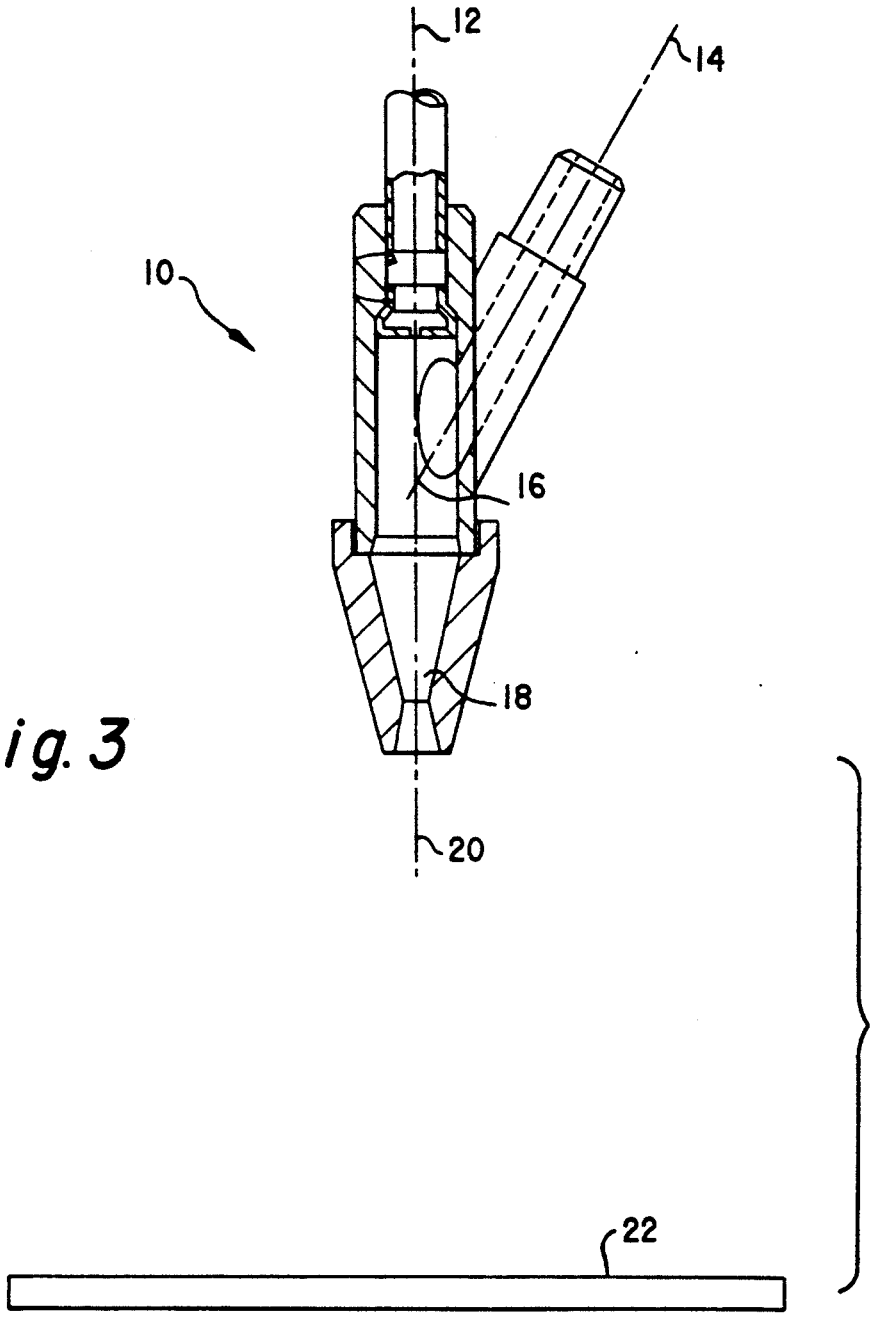

In FIGS. 2 and 3 an embodiment of the apparatus is illustrated in which on the nozzle region 18 of the mixing head 10 an attachment 30 is disposed via which the gaseous refrigerant 36 is injected into the conically widening rotating mixture jet 19.

Via a regulating valve 42 and a feed conduit 40 gaseous refrigerant is supplied from a refrigerant reservoir 44 to an annular tube 32 and via uniformly distributed outlet nozzles 34, i.e. at identical angular intervals along the ring 32, is blown from the outside into the conically propagating mixture beam 19.

The annular tube 32 comprises spokes 38 which project radially inwardly from the ring 32 and the ends of which opposite the ring 32 are connected in turn by means of a securing ring 46. The securing ring 46 is screwed to the outside of the nozzle region 16 of the mixing head 10 by screws 48 with pointed ends. In the embodiment illustrated the outer side of the mixing head 10 consists of plastic so that by this simple force locking a very good connection is obtained.

The annular arrangement of the refrigerant outlet nozzles 34 outside the conical mixture jet 19 avoids any undesirable apparatus influencing of the mixing jet 19. Now, in order to keep the impairment of the mixture jet propagation as low as possible with nevertheless as intensive as possible a heat exchange between the jet 19 and the refrigerant, the refrigerant jets 36 are directed onto the mixture jet 19 at a distance of 5 to 10 cm from the nozzle outlet 50 of the mixing head 10. For this purpose, in the embodiment illustrated the diameter of the annular tube 32 is made about 7 mm, the distance of the tube 32 from the nozzle outlet 50 about 5 cm and the angle at which the refrigerant jets 36 impinge with respect to the centre axis 20 of the mixture jet 19 about 45°. An angle which is too blunt, for example an angle larger than 60°, would too greatly constrict the mixture jet and in addition have an excessive detrimental effect on the rotational movement of the particles thereof, whereas an angle which is too acute, i.e. less than 30°, reduces the intensity of the heat exchange.

Figure 4:
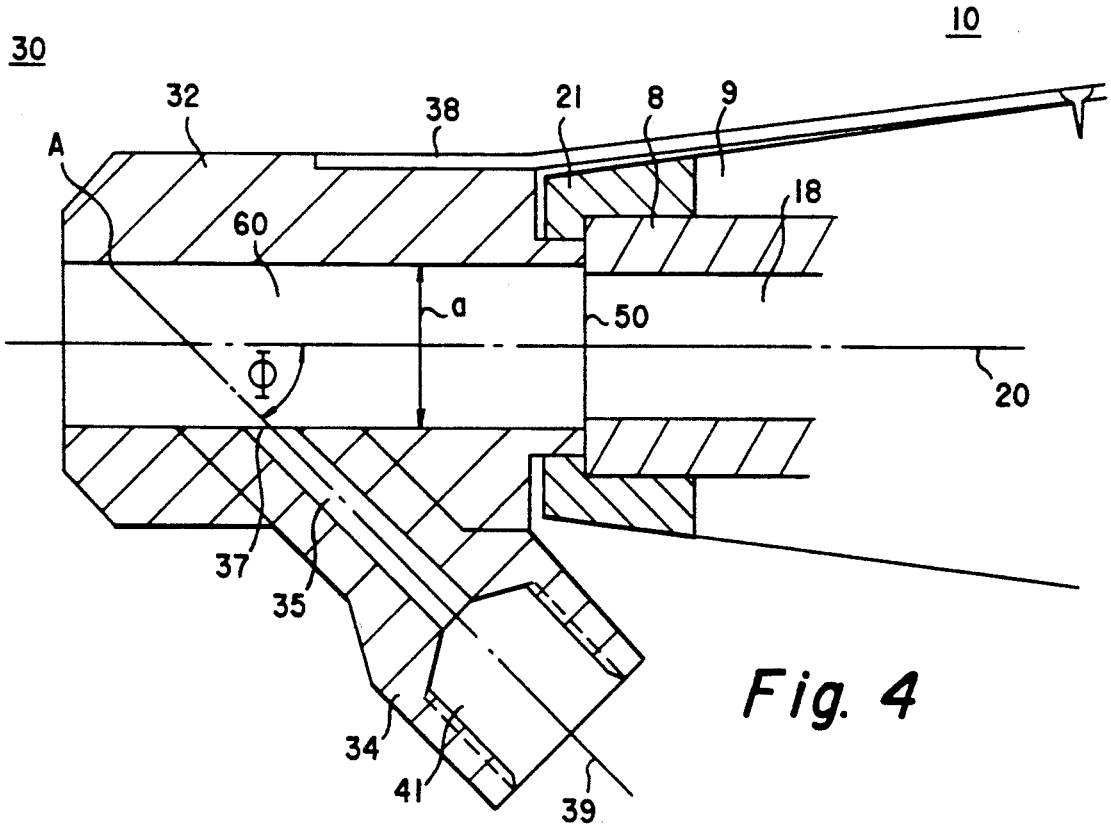
FIG. 4 is a sectional view of another embodiment for the injection of gaseous refrigerant into the mixture jet.

FIG. 4 shows an arrangement 30 where the ring member 32 directly adjoins the nozzle region 18 of the mixing head 10. The nozzle region 18 of the mixing head 10 and the passage 60 of the ring member 32 have a cross section which is circle-cylindrically shaped. In this embodiment the passage 60 is about 12 mm in diameter and about 30 mm in length. It is not mandatory that the cross-sectional area of the passage 60 is greater than that of the nozzle region 18 as is indicated in FIG. 3, but it should not be smaller than the cross sectional area of the nozzle region 18.

The ring member 32 is at its periphery provided with a single refrigerent agent nozzle 34 having a through-bore 35 which serves as a refrigerent passage to which liquid nitrogen can be supplied as refrigerant via the bore extension 41. The through-bore 35 has a diameter of about 2 to 5 mm, preferably 3 mm, and is inclined at an angle Φ of approximately 30° to 60°, preferably at an angle Φ of approximately 45°, to the middle axis 20 of the cleaning agent jet 19 in the direction of the jet. The middle axis 39 of the through-bore 35 intersects with the middle axis 20 of the cleaning agent jet 19 and impinges at A the wall of the ring member 32, which opposes the through-bore 35. Thereby it is achieved that the rotating cleaning jet 19 experience almost no deflection by the introduced refrigerant. On the contrary, the rotational energy of the cleaning jet is enhanced. Lastly, the cooling effect of the liquid nitrogen is enhanced because of the longer contact time with the particles of the cleaning jet 19.

The outlet of the refrigerant nozzle 34 adjoins in this embodiment directly the cleaning jet 19. The refrigerant, in this case liquid nitrogen, is thereby directly contacted with the particles of the blast material which are to be crystallized.

To seal the region between the nozzle region 18 and the ring member 32 an isulating member in the form of an isolating ring 21 is provided, which additionally serves as a protection for the shell 9 of the nozzle region 18 which is internally lined by a ceramic material 8. The shell 9 consists of a plastics material.

The ring member 32 is fastened to the shell 9 by means of struts 38.

The ring member 32 is fabricated of a rust-resistant and low temperature resisting material, for example stainless steel (VA steel).

A possible admixture of mineral blast materials is carried out as described in detail in European patent no. 0 171 448 in that instead of compressed air a blast material/air mixture is supplied via the tube piece 14.

We claim:

1. A method for cleaning surfaces comprising:

forming a jet while atomizing a liquid cleaning agent in a mixing region;

causing said jet to rotate about a center axis as said jet is formed;

intermixing a refrigerant into said jet of atomized liquid cleaning agent downstream of said mixing region to cool and crystallize said atomized cleaning agent to particles; and directing said jet of crystallized cleaning agent particles onto a surface to be cleaned.

2. The method as claimed in claim 1, wherein said intermixing is by spraying a liquid refrigerant into said jet.

3. The method as claimed in claim 1, wherein said liquid refrigerant is nitrogen.

4. The method as claimed in claim 1, wherein said intermixing is by injecting a gaseous refrigerant into said jet.

5. The method as claimed in claim 4, wherein said gaseous refrigerant is carbon dioxide.

6. The method as claimed in claim 4, wherein said gaseous refrigerant is Freon.

7. The method as claimed in claim 1, further comprising adding a granulate material while forming said jet and atomizing said liquid cleaning agent.

8. The method as claimed in claim 7, wherein said granulate material is selected from the group consisting of a mineral granulate and walnut shells.

9. A method for cleaning surfaces comprising:

forming a jet while atomizing a liquid cleaning agent in a mixing region;

intermixing a refrigerant into said jet of atomized liquid cleaning agent downstream of said mixing region to cool and crystallize said atomized cleaning agent to particles by spraying said refrigerant into said jet of atomized liquid cleaning agent in a ring member downstream of said mixing region with said refrigerant impinging on an opposite wall of said ring member; and directing said jet of crystallized cleaning agent particles onto a surface to be cleaned.

10. The method as claimed in claim 9, wherein said spraying of said refrigerant has a middle axis inclined at an acute angle from a middle axis of said jet in the jet direction.

11. The method as claimed in claim 9, wherein said spraying of said refrigerant has a middle axis offset from a central axis of said jet by an eccentricity.

12. The method as claimed in claim 9, wherein said spraying of said refrigerant has a middle axis inclined at an acute angle from a middle axis of said jet in the jet direction and offset from a central axis of said jet by an eccentricity.

* * * * *